US005540123A

United States Patent [19]

Lund

[11] Patent Number: 5,540,123

[45] Date of Patent: Jul. 30, 1996

[54] TORQUE TRANSFER DEVICE

[75] Inventor: David R. Lund, Charleston, S.C.

[73] Assignee: Victory in Jesus Ministries, Inc., Charleston, S.C.

[21] Appl. No.: 306,692

[22] Filed: Sep. 15, 1994

Related U.S. Application Data

[63] Continuation-in-part of Ser. No. 242,196, May 13, 1994, which is a continuation-in-part of Ser. No. 75,787, Jun. 14, 1993, abandoned.

[51] Int. Cl.[6] ..... B25B 17/00

[52] U.S. Cl. ..... 81/57.3; 81/57.43

[58] Field of Search ..... 81/57.3, 57.43, 81/57.14

[56] References Cited

U.S. PATENT DOCUMENTS

| | | | |
|---|---|---|---|
| 141,259 | 7/1873 | Bubser | 81/57.3 |
| 3,138,983 | 6/1964 | Frizzell | 81/57.3 |
| 3,714,852 | 2/1973 | Giangrasso | 81/57.3 |

*Primary Examiner*—James G. Smith
*Attorney, Agent, or Firm*—B. Craig Killough

[57] ABSTRACT

A torque transfer device allows torque to be input at one point of the device and transferred to another point of the device at which the power or torque can be taken from the device. The device incorporates a direct drive means comprised of a plurality of links having an arcuate shape of constant radius which form a continuous loop, with alternating links having an orifice. The direct drive means drives gears which have teeth which protrude into said orifice.

16 Claims, 5 Drawing Sheets

TORQUE TRANSFER DEVICE

This application is a continuation-in-part of application Ser. No. 08/242,196, filed May 13, 1994, which is a continuation-in-part of application Ser. No. 08/075,787, filed Jun. 14, 1993, now abandoned.

FIELD OF THE INVENTION

This invention relates to a device for transferring torque by continuous loop direct drive means which transfers torque from a first drive gear to a second drive gear, and is particularly directed to a device for the transfer of relatively high torque within a confined space, or where the device is enclosed in a relatively small housing.

BACKGROUND OF THE INVENTION

There are many devices which transfer torque, or rotational velocity, from one point to another. Chains, belts and similar direct drive means transfer rotational movement from one gear or pulley or similar drive means to a second or subsequent gear or pulley or similar driven means.

In some applications, it is desirable to transfer relatively high torque from one point to another point, or from one device to another device. In such applications, space limitations may be a factor. The relatively high torque to be transferred may preclude the use of torque transfer devices which cannot handle heavy duty loads, while space does not permit the use of large devices.

An example of such space limitations are torque transfer devices which are placed within enclosures. Examples of devices which transfer relatively high torque are tools which are used to tighten fasteners by the application of torque. Engines and motors use torque transfer devices both operationally, such as camshaft drives, and as power take off devices, such as chain drives on motorcycles. High torque and limited space is a factor in such devices.

Various wrenches, extensions, ratchets, adapters and power transfer tools and devices are disclosed in the prior art. Similarly, camshafts and similar devices are driven by the application of relatively high torque where space for the application of the drive means is limited. Problems are encountered with such devices where the devices are enclosed in relatively small housings, or are otherwise required to be relatively compact in comparison to the torque to be transferred. Common problems experienced with the devices of the prior art include friction and wear between the housing of the device and the drive means, inadequate strength of the drive means or gears, and inadequate or improper engagement of the drive means and the gears due to space limitations.

SUMMARY OF THE PRESENT INVENTION

The present invention is a device which transfers torque from one point to a second remote point of the device. A drive means or drive tool inputs torque into the device at a first point, and the rotational movement, and torque, is taken, or harvested, from the second remote point. Typically, the transfer of the rotation by the tool will be along a path of travel which is not on the same axis as the rotation of the drive tool.

The invention incorporates a direct drive means which connects a first drive gear to a second drive gear. The first gear rotates as torque is applied to the first gear, and as the direct drive means is engaged by the first gear, the direct drive means engages the second drive gear, causing it to rotate.

The direct drive means is comprised of a plurality of links connected to form a continuous loop. Each link has an arcuate shape of constant diameter which corresponds to the outer circumference of the drive gears. The links are joined end to end and pivot relative to each other. Each alternating link has an orifice which receives a tooth of the drive gear as the link rotates through the gears.

The use of links having an arcuate shape of constant diameter causes the links to form a portion of a circle as the links rotate through the gears. This partially circular shape corresponds to the circumference of the drive gears, and extends from the circuference of the drive gears. Particularly when the device is used in limited space, such as in a housing, the arcuate shape of the links allows the device to fit within the limited space. Further, the use of links having an arcuate top surface, with some links having a smooth top surface, results in minimal friction and wear if the direct drive means contacts the housing. Other features of the invention are apparent from the drawings and the descriptions herein.

DESCRIPTION OF THE DRAWINGS OF THE PREFERRED EMBODIMENT

DESCRIPTION OF THE PREFERRED EMBODIMENT

The present invention is characterized by a direct drive means which is driven by a first drive gear, or pulley, or similar rotational device, which, in turn, drives a second drive gear, a pulley, or a similar rotational device. The direct drive means then transfers torque from a first rotating member to a second, or perhaps subsequent, rotating member.

Figure 1:
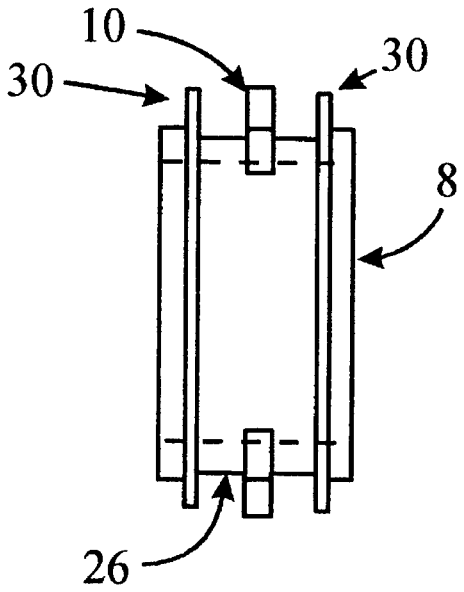
FIG. 1 is a frontal view of a drive gear.
Figure 2:
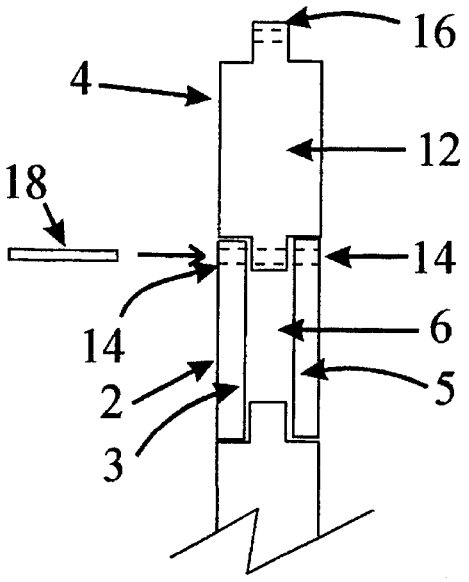
FIG. 2 is a top plan view of a section of direct drive means showing alternating links, with an arrow indicating the insertion of a pivot pin to join the links.

Referring now to the drawing figures, FIG. 2 shows a section of the direct drive means. Each alternating link has a first plate 3 and a second plate 5. The plates 3,5 are generally parallel to each other, and an orifice 6 is formed between the first plate and the second plate. Each alternating link 2 of the direct drive means has an orifice 6 therein which receives a tooth 10 of a drive gear 8 as the direct drive means rotates through the drive gear. Each remaining link 4 has a smooth and closed top surface 12.

The continuous direct drive means is formed by a series of alternating links 2 which are connected to one of each of the remaining links 4 at each end, until a continuous loop of the required length is formed. The links are pivotally connected, so that the links pivot relative to each other. As shown in FIG. 2, each alternating link has two arms 14 extending from each end of the link. Each remaining link has a protrusion 16 extending from each end of the link. The protrusion is inserted between the two arms, and the links are joined in a pivotal fashion by a connecting member which allows the pivoting or limited rotation of the links relative to each other. The connecting member may be a pin 18 which is inserted through the two arms and the protrusion to join the links. The pin may be fixed in the two arms of the alternating link, with the remaining link allowed to rotate about the pin.

Figure 3:
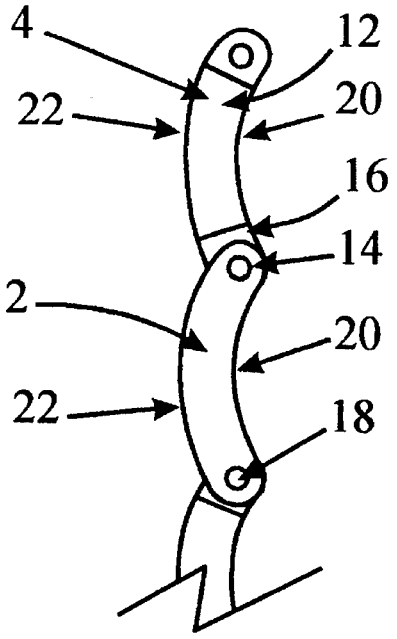
FIG. 3 is a side view of the section of direct drive means of FIG. 2.

Each of the links has an arcuate shape of constant radius as shown in FIG. 3. Each of the links has the same radius, and is of approximately the same length and width. The links have a bottom surface 20 of constant radius and a top surface 22 of constant radius, which makes up the generally arcuate shape of the links. For the purpose of this disclosure, the bottom surface of the link is defined as the surface of the link which adjoins the drive gear, while the top surface of the link is opposite the drive gear. When the links are viewed from the side, as in FIG. 3, the top surface and bottom surface have a concentric, arcuate shape, which may be rounded as the ends of the links are formed.

Figure 4:
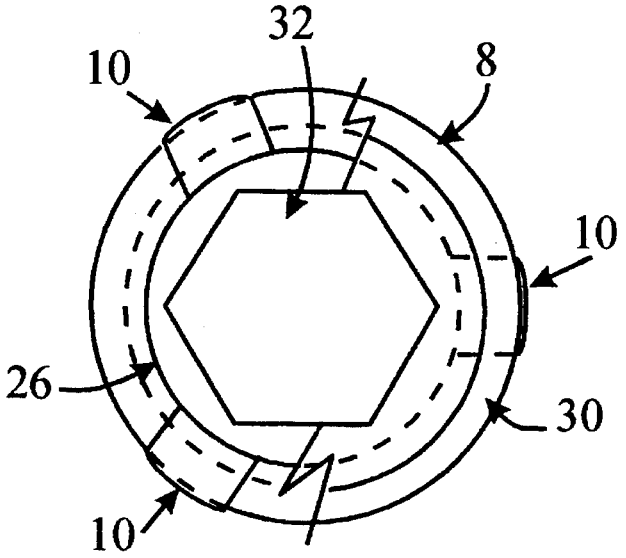
FIG. 4 is a side view of a drive gear of FIG. 4, partially sectioned to reveal the teeth of the drive gear.

The links are pivotally joined end to end to form a continuous loop. The end of the link is defined as the part of the link which is attached to or joins with the next, or adjoining, link. The continuous loop direct drive means rotates through a first drive gear and a second drive gear. A drive gear 8 is shown in FIG. 4. The drive gear has an outer circumference 26. This outer circumference is of a radius which is generally the same as the radius of the bottom surface 20 of the links. The outer circumference forms a circle. A plurality of teeth 10 extends radially from the drive gear, and more specifically, from the surface which forms the outer circumference of the drive gear. The drive gear may have flanges 30 on one or both sides of the drive gear.

Typically, the drive gears will have a void 32 in the center which provides a means by which the drive gear may be driven, and power may be taken from the drive gear. The void may be provided in the drive gear for insertion of a drive means to drive the drive gear, and a void may be provided on the remaining drive gear for insertion of a driven means, or power takeoff means.

Commonly, the present invention will be used with hand tools or power tools. Hand tools and power tools in use commonly use six point, or hexagonal, engagement means, or twelve point engagement means. Accordingly, the device as shown has three teeth extending from the drive gears 8,24. The teeth correspond to the flat spot in the void of the gear. Since each alternating link of the device has an orifice for receiving the teeth, the sum of the arc which forms the bottom surface of six links joined together will equal the outer circumference of the drive gear. Stated otherwise, each link has a length along the arc which forms the bottom surface which is approximately one sixth the outer circumference of the drive gear. The length is approximate since the links are joined end to end, and the bottom surface of the individual links may actually be somewhat longer than one sixth of the outer circumference of the drive gear.

In use, a gear is rotated by application of torque from another rotating device, or drive means. The rotating device could be any known tool, including a wrench, ratchet, screwdriver, or a power tool, a motor, or a transmission, or other device which will apply a rotational force to the gear. The rotation of the direct drive means by the first gear 23 causes rotation of the second gear 24. In this manner, torque is transferred to the second gear. Power take off means may be supplied, and application means, such as a tool, a generator, a pump, or other device which is actuated by the application of torque could be used. For the purpose of increasing or decreasing torque, or increasing or decreasing rotational speed, gears of different effective diameters could be employed, if space permits.

Figure 5:
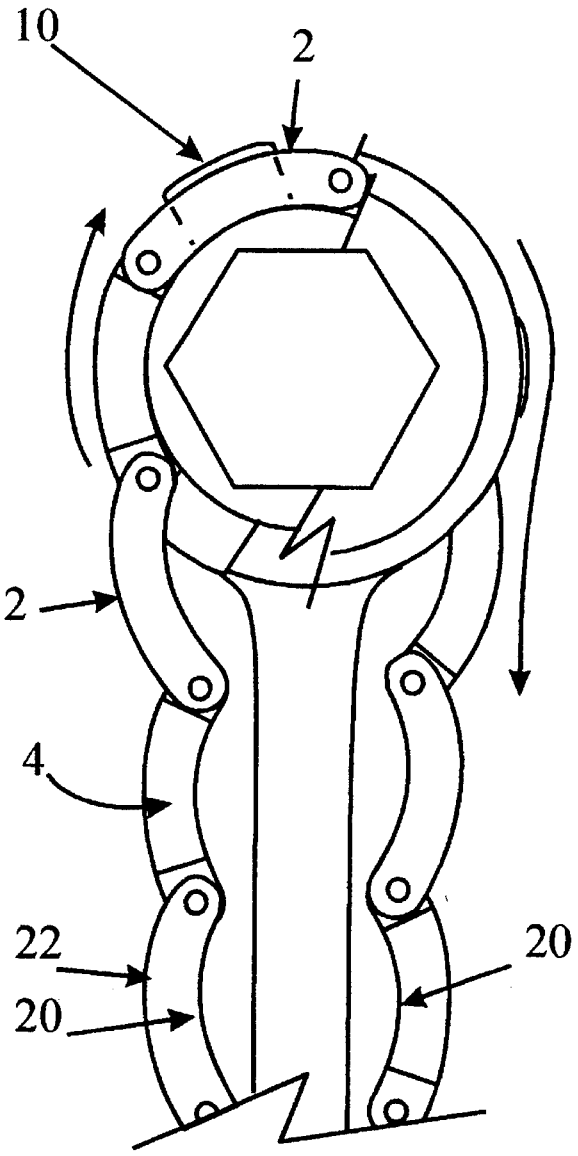
FIG. 5 shows the drive means as it rotates through the drive gear, with arrows indicating the direction of rotation.
Figure 6:
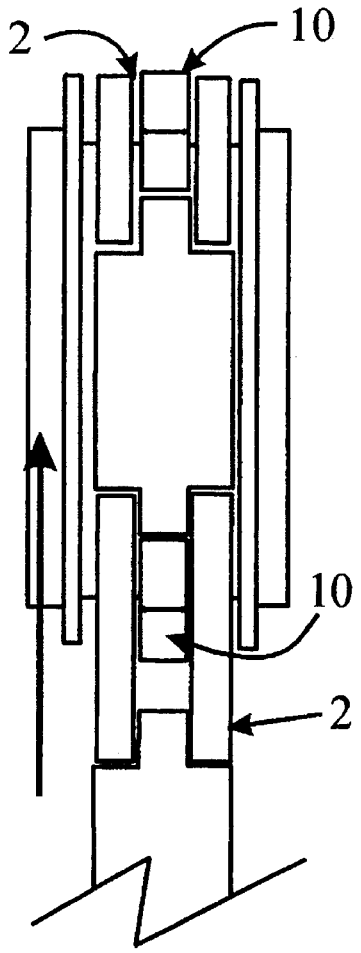
FIG. 6 is another view of the device as shown in FIG. 5.

As shown in FIG. 5, the direct drive means rotates through the gear, either driving, or being driven by, the gear. Each of the alternating links engages one of the teeth of the drive gear as the direct drive means rotates through the gear. The bottom arcuate surface of the links contact the outer circumference of the drive gear. The bottom arcuate surface of the links is approximately the same radius as the radius of the surface of outer circumference of the drive gear. The direct drive means engages the gear and enters the gear between the flanges of the gear, if flanges are used. Further, the formation of the partially circular shape within the gears by the links, which is an extension of the radius of the gear, means that the presence of the links within the gears strengthens the gears and the device. This feature is important since the presence of the void 32 weakens the gear. Very little material may be present between the void and the outer circumference of the gear where hexagonal drives are used.

Figure 7:
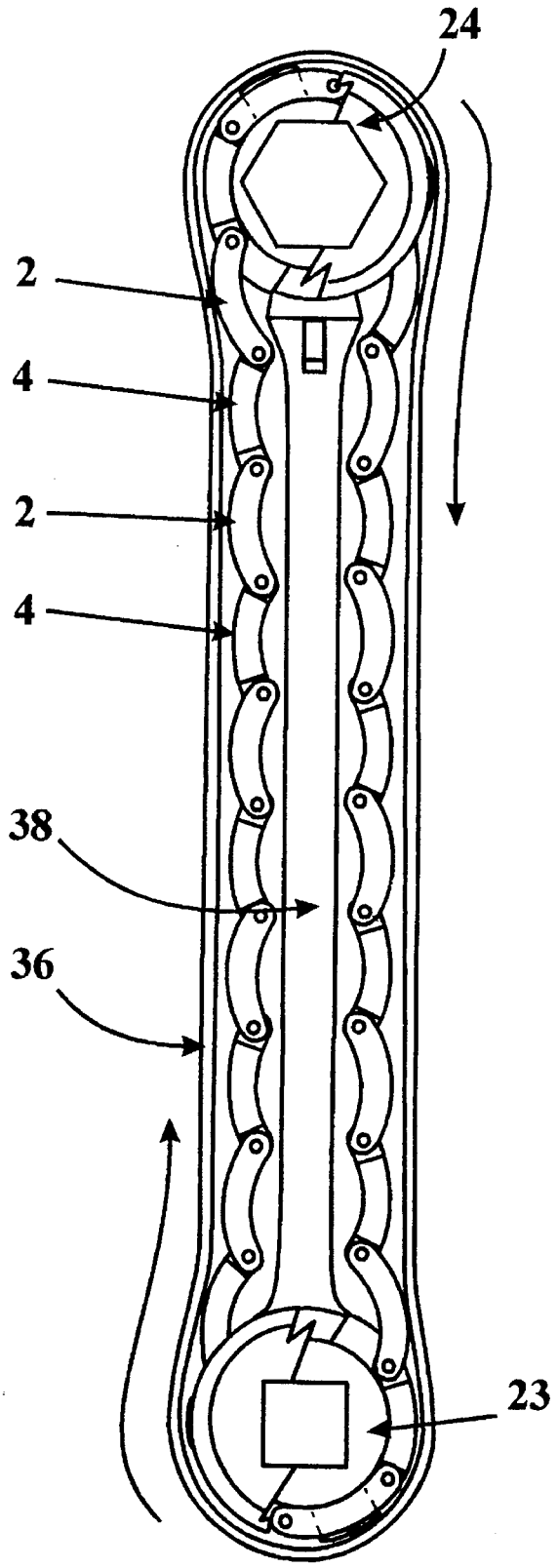
FIG. 7 is a view of the device positioned within a housing.
Figure 8:
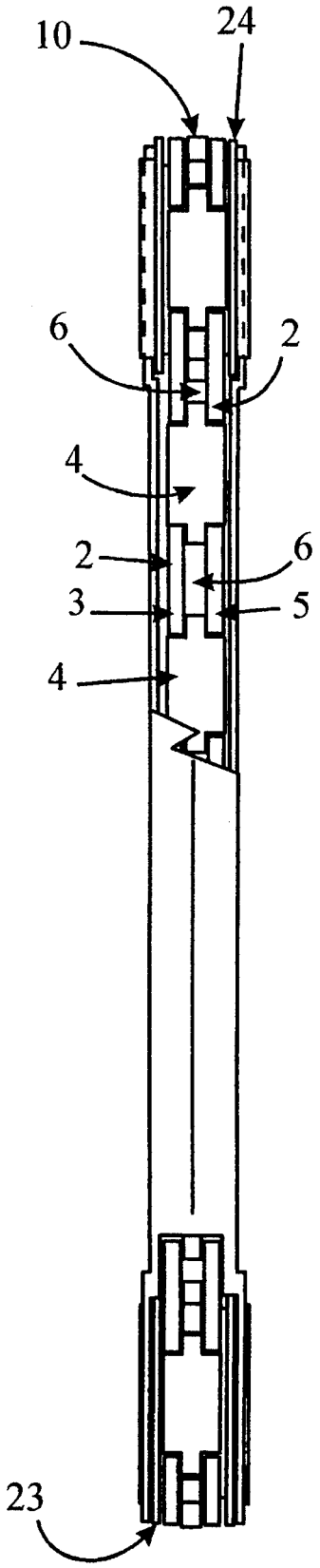
FIG. 8 is a side view of the housing of FIG. 7 partially sectioned to show the direct drive means.
Figure 9:
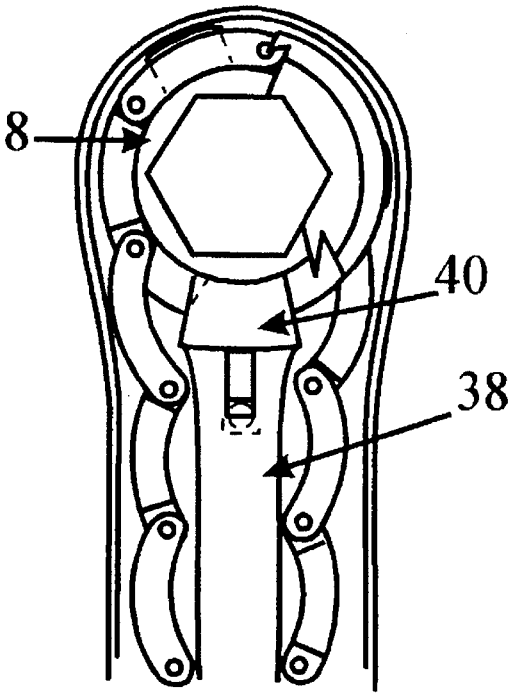
FIG. 9 is a partial view of the housing showing a drive gear positioned within the gear housing.
Figure 10:
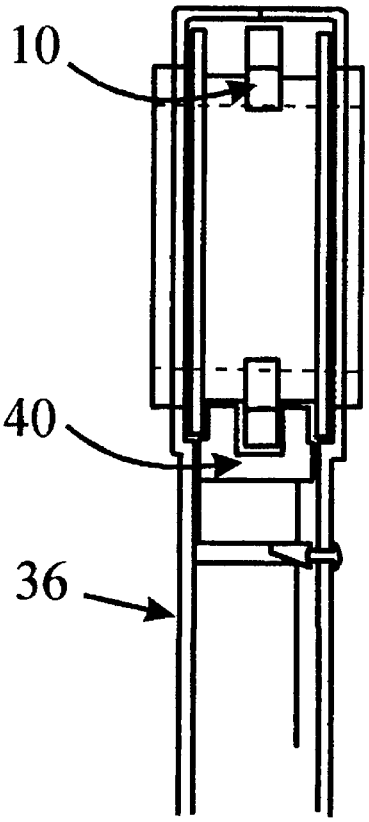
FIG. 10 is another view of the device shown in FIG. 9.

The device may be placed within a housing 36. The housing may be elongated. A longitudinally and centrally disposed wall 38 may be placed within the housing, if used, to separate the portions the drive means moving in opposite directions as the gears rotate. The wall may have a lubricant or low frictional quality, by the use of a material such as teflon at the point of contact of the drive means with the wall. The arcuate shape of the top surface of the links facilitates the rotation of the device within the housing, which will usually have an enlarged gear housing of constant radius on each end, as shown in FIG. 7.

The tolerances of the direct drive means are critical. Due to the large number of links, small deviations add up. An adjustment means 40 may be included. The adjustment means allows one or both of the gears to be pushed toward either end of the device to take up slack in the direct drive means as needed. The adjustment means may be connected to or extend from the wall The adjustment means may be secured as desired by a locking screw or other locking means. A slot may be provided for the locking means to provide for adjustment of the adjustment means.

The housing may be arcuate. An object of the present invention is to provide a device which will transfer torque to a point where there is difficulty in positioning a drive. The use of various shapes, including straight lines and arcs for the housing furthers this object of the invention.

A primary goal of the present invention is to provide a torque transfer device which may be used in applications where a great amount of torque is to be transferred, but operational space is limited. Accordingly, the configuration of the direct drive means is critical to the invention, and the use of the arcuate shaped individual links of constant radius accomplishes a goal of the invention. The arcuate shaped links form a partially circular shape as they rotate through the gears, thereby minimizing the space occupied when compared to other possible configurations. The arcuate top surfaces of the links have no extensions or protrusions, and the shape of the top surface minimizes friction in the event of contact of the links with a housing or other environment in which the device is used. While the device is very space efficient, the structure of the links provides a direct drive means which is extremely strong and capable of carrying high torque loads, with minimal loss of energy due to friction.

The best mode of using the device is as extension for tools. A drive, such as the drive of a ratchet or air wrench is inserted into the first drive gear 23. The direct drive means transfers torque to the second drive gear 24, and a socket or other tool can be used to tighten or loosen a threaded fastener at a location which is remote from the wrench. The device is particularly suited to such an application since tools for torquing threaded fasteners must be able to handle high torque, while the space in which such tools are used is frequently limited, meaning that the tool must be as small as possible. Other uses for the device are apparent from the disclosure of the device herein.

It is not necessary that the drive gears rotate within the same plane. The application of torque may be directed to position the device to rotate on a plane which is perpendicular to, or otherwise different than, the plane within which the first gear rotates. One or more idler gears could be used to facilitate such directional change.

What is claimed is:

1. A torque transfer device, comprising a. a first drive gear and a second drive gear wherein each of said drive gears has a plurality of teeth extending radially from an outer circumference of said drive gears; and b. a continuous loop direct drive means comprising a plurality of pivotally connected links each having a generally arcuate shape of constant radius, wherein each alternating link of said plurality of links comprises a first plate and a second plate, each of which is arcuate in shape, along a top surface and along an inner radius and wherein said inner radius of said first plate and second plate is approximately equal to an outer radius of said first gear and said second gear which contact said first plate and said second plate as said direct drive means rotates through said first gear and said second gear, and wherein said first plate is generally parallel to said second plate, and an orifice is present between said first plate and said second plate, and said orifice receives one of said teeth as said direct drive means passes through each of said drive gears; and c. a housing which surrounds said first drive gear, said second drive gear and said continuous drive means;

wherein said direct drive means provides communication between said first drive gear and said second drive gear, and wherein rotation of said first drive gear causes, in turn, rotation of said second drive gear.

2. A torque transfer device as described in claim 1, wherein a top surface of each of said links has a generally arcuate shape of constant radius.

3. A torque transfer device as described in claim 2, wherein each alternating link of said plurality of links comprises said orifice therein and each remaining link has a closed and arcuate top surface of relatively constant diameter, wherein the top surface has a width which is approximately equal to the width of each alternating link.

4. A torque transfer device as described in claim 3, wherein each alternating link of said plurality of links has two arms extending from each end thereof and each remaining link has a protrusion extending from each end thereof, wherein each of said alternating links is pivotally joined at each end to one of said remaining links by means of pin which is inserted through said arms of said alternating link and through said protrusion of said remaining link.

5. A torque transfer device as described in claim 1, wherein a length of an arc which forms a bottom surface of each of said plurality of links is approximately one sixth of the outer circumference of said drive gears.

6. A torque transfer device as described in claim 2, wherein a length of an arc which forms a bottom surface of each of said plurality of links is approximately one sixth of the outer circumference of said drive gears.

7. A torque transfer device as described in claim 3, wherein a length of an arc which forms a bottom surface of each of said plurality of links is approximately one sixth of the outer circumference of said drive gears.

8. A torque transfer device as described in claim 4, wherein a length of an arc which forms a bottom surface of each of said plurality of links is approximately one sixth of the outer circumference of said drive gears.

9. A torque transfer device as described in claim 1, wherein said first gear further comprises a flange on said first gear which is present on each side of said direct drive means as said direct drive means rotates through said first gear.

10. A torque transfer device as described in claim 2, wherein said first gear further comprises a flange on said first gear which is present on each side of said direct drive means as said direct drive means rotates through said first gear.

11. A torque transfer device as described in claim 3, wherein first gear further comprises a flange on said first gear which is present on each side of said direct drive means as said direct drive means rotates through said first gear.

12. A torque transfer device as described in claim 4, wherein first gear further comprises a flange on said first gear which is present on each side of said direct drive means as said direct drive means rotates through said first gear.

13. A torque transfer device as described in claim 5, wherein first gear further comprises a flange on said first gear which is present on each side of said direct drive means as said direct drive means rotates through said first gear.

14. A torque transfer device as described in claim 6, wherein first gear further comprises a flange on said first gear which is present on each side of said direct drive means as said direct drive means rotates through said first gear.

15. A torque transfer device as described in claim 7, wherein first gear further comprises a flange on said first gear which is present on each side of said direct drive means as said direct drive means rotates through said first gear.

16. A torque transfer device as described in claim 8, wherein first gear further comprises a flange on said first gear which is present on each side of said direct drive means as said direct drive means rotates through said first gear.

* * * * *